US011609050B2

(12) United States Patent
Walls

(10) Patent No.: US 11,609,050 B2
(45) Date of Patent: Mar. 21, 2023

(54) HEADER-TANK ASSEMBLY

(71) Applicant: Valeo North America, Inc., Auburn Hills, MI (US)

(72) Inventor: Raul Walls, Auburn Hills, MI (US)

(73) Assignee: Valeo North America, Inc., Auburn Hills, MI (US)

( * ) Notice: Subject to any disclaimer, the term of this patent is extended or adjusted under 35 U.S.C. 154(b) by 31 days.

(21) Appl. No.: 15/931,924

(22) Filed: May 14, 2020

(65) Prior Publication Data

US 2021/0356219 A1 Nov. 18, 2021

(51) Int. Cl.
*F28F 9/00* (2006.01)
*F28F 9/02* (2006.01)

(52) U.S. Cl.
CPC ..... *F28F 9/02* (2013.01)

(58) Field of Classification Search
CPC ..... F28F 9/02; F28F 9/0219; F28F 9/0226; F28F 9/26; F28F 9/0224; F28F 9/165; F28F 9/0204; F28F 9/04; F28F 9/12; F28D 1/05375
See application file for complete search history.

(56) References Cited

U.S. PATENT DOCUMENTS

2005/0039894 A1* 2/2005 Brost ..... F28F 9/0226 165/149
2014/0262179 A1* 9/2014 Snow ..... F28F 9/0226 165/173
2015/0096725 A1* 4/2015 Holmes ..... F28D 1/05366 165/151
2015/0233652 A1* 8/2015 Yamamoto ..... F28F 9/04 165/173

FOREIGN PATENT DOCUMENTS

DE 3222278 A1 * 12/1983 ..... F28F 9/0226

* cited by examiner

*Primary Examiner* — Harry E Arant
(74) *Attorney, Agent, or Firm* — Osha Bergman Watanabe & Burton LLP

(57) ABSTRACT

A tank for a heat exchanger is provided. The tank includes a foot portion, an internal wall, a sealing member and at least one first coupling member. The internal wall is formed along the foot portion at a first end of the foot portion. Further, the sealing member is disposed on the foot portion along an outer circumference of the internal wall to provide a fluid-tight sealing between the tank and a header, when the tank is placed on the header. The at least one first coupling member is provided on the foot portion, adjacent to the sealing member, to couple with the header.

12 Claims, 10 Drawing Sheets

HEADER-TANK ASSEMBLY

FIELD OF THE INVENTION

The present invention generally relates to a header-tank assembly for a heat exchanger, more particularly, relates to a header-tank assembly having a sealing member disposed on a groove defined on a tank.

BACKGROUND OF THE INVENTION

Generally, a heat exchanger having a tank to enable fluid communication to a core of the heat exchanger. The core is provided with a header, on which the tank is connected thereon. Although the tank is fluidically connected to the header, the fluid may leak from the connection point between the tank and the header. To have a fluid tight connection between the tank and the header, a gasket is disposed on the header. The gasket is provided on a groove defined on the header to provide fluid tight sealing between the tank and heater of the heat exchanger. However, while assembling the tank on the header, the gasket may compromise the sealing function, due to the uncontrolled groove provided on the header. Further, the gasket may dislocate from the groove while positioning the tank on the header, which leads to improper sealing between the header and the tank. In case the gasket is displaced from the groove, the foot portion of the tank may step on the gasket, while assembling the tank on the header. In such cases, the gasket may be subjected to pinching, which leads to damaging of the gasket, thereby the gasket losses the sealing property. Therefore, the connection point between the tank and header may have fluid leakages that affects the efficiency of the heat exchanger. In case the gasket is displaced from the groove formed on the header, it is cumbersome to preassemble the gasket on the header before the tank is positioned on the header. As the gasket is displaced while assembling the tank on the header, it requires more time to properly place the gasket on the groove of the header, thereby the assembly time of the tank on the header is increased.

Accordingly, there remains a need for a header-tank assembly, in which a gasket is preassembled before coupling the tank on the header. Further, there remains another need for a tank having coupling features that reduce assembling time of the tank on a header of a heat exchanger. Further, there remains another need for a header-tank assembly that avoids damaging of a gasket provided in the assembly while assembling the tank on the header.

SUMMARY OF THE INVENTION

In the present description, some elements or parameters may be indexed, such as a first element and a second element. In this case, unless stated otherwise, this indexation is only meant to differentiate and name elements, which are similar but not identical. No idea of priority should be inferred from such indexation, as these terms may be switched without betraying the invention. Additionally, this indexation does not imply any order in mounting or use of the elements of the invention.

In view of the foregoing, an embodiment of the invention herein provides a tank for a heat exchanger. The tank includes a foot portion, an internal wall, a sealing member and at least one first coupling member. The internal wall is formed along the foot portion at a first end of the foot portion. Further, the sealing member is disposed on the foot portion to provide a fluid-tight sealing between the tank and a header, when the tank is placed on the header. The at least one first coupling member is provided on the foot portion, adjacent to the sealing member, to couple with the header.

In one embodiment, the tank further includes an outer wall formed along the foot portion at the second end of the foot portion. Further, the internal wall is parallel to the outer wall.

Generally, the internal wall and the outer wall are perpendicularly protruded from the foot portion of the tank.

Further, tank includes a groove defined on the foot portion to receive the sealing member.

In one embodiment, the groove is formed on the foot portion at a distance (d) from the internal wall of the tank. Further, the groove is a U-shaped groove and the open end of the U-shaped groove is adapted to be closed when the tank is positioned on the header.

In another embodiment, the groove is defined on the foot portion at a corner connecting the internal wall with the foot portion of the tank.

According to another aspect, a header-tank assembly having the tank is provided. The header-tank assembly includes at least one second coupling member, complementary to the at least one first coupling member, formed on a periphery of the header. Further, the at least one second coupling member is adapted to be coupled with the at least one first coupling member formed on the tank to enable a connection between the header and the tank.

In one embodiment, the at least one first coupling member is a slot defined between the internal wall and the outer wall, on the foot portion of the tank. Further, the at least one second coupling member is a leg adapted to be received in the slot to couple the tank on the header.

Further, each of the legs includes a slope adapted to be slightly deformed, when the legs pass through the slots formed in the tank, to lock the tank with the header.

In another embodiment, the legs are adapted to be crimped over the foot portion of the tank, upon the legs passing through the slots formed on the foot portion of the tank.

In one example, the at least one first coupling member and the at least one second coupling member are a snap fit assembly adapted to couple with each other.

Further, the foot portion of the tank includes a ramp formed on the outer wall to enable sliding of the at least one second coupling member into the at least one first coupling member.

Further, the sealing member includes protruded elements connected to the sealing member at a side of the sealing member.

BRIEF DESCRIPTION OF THE DRAWINGS

Other characteristics, details and advantages of the invention can be inferred from the description of the invention hereunder. A more complete appreciation of the invention and many of the attendant advantages thereof will be readily obtained as the same becomes better understood by reference to the following detailed description when considered in connection with the accompanying figures, wherein.

It must be noted that the figures disclose the invention in a detailed enough way to be implemented, the figures helping to better define the invention if need be. The invention should however not be limited to the embodiments disclosed in the description.

DETAILED DESCRIPTION

The present invention relates a header-tank assembly for a heat exchanger. Conventional header-tank assembly may include a tank and a header provided with a gasket to enable sealing between the tank and the header. However, such gasket is not optimal to provide effective sealing between the tank and the header, since the gasket may displace from its position on the header when the tank is positioned on the header. In case the gasket displaces while assembling the tank on the header, the tank may damage the gasket. To avoid such scenario, a header-tank assembly for a heat exchanger is proposed. The header-tank assembly includes a header and a tank having a groove to receive a sealing member. The sealing member is received in the groove provided in the tank and connected on the header of the heat exchanger. As the sealing member is provided in the tank in a controlled groove, the sealing member does not displace from the groove, thereby avoiding pinching of the sealing member. Further, the header-tank assembly is provided with a connection assembly, such as a poke-yoke or snap fit, to enable ease assembly of the tank on the header of the heat exchanger.

Figure 1:
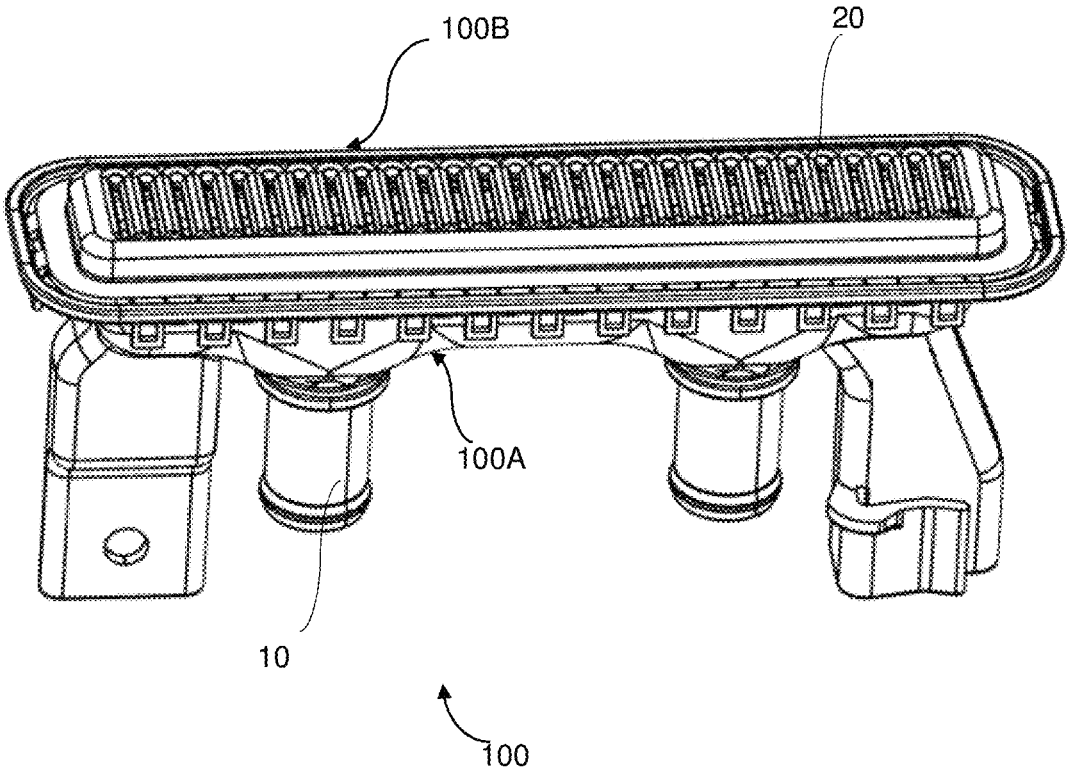
FIG. 1 illustrates a perspective view of a header-tank assembly of a heat exchanger, in accordance with an embodiment of the present invention.

FIG. 1 illustrates a perspective view of a header-tank assembly 100 of a heat exchanger, in accordance with an embodiment of the present invention. The header-tank assembly 100 includes a tank 100A and a header 100B adapted to be coupled to the tank 100A. The tank 100A may include an inlet/outlet 10 fluidically couples the heat exchanger with an external circuit. The header 100B may include tube slots 20 to receive heat exchange tubes/plates (not shown in figures) defined with two different fluid circuit fluidically isolated with each other. As the tank 100A is coupled with the header 100B, a sealing member (not shown in FIG. 1) needs to be provided to avoid fluid leakage from the connection point between the tank 100A and the header 100B. Positioning and geometry of the tank 100A and the header 100B are explained in the forthcoming figures.

Figure 2A:
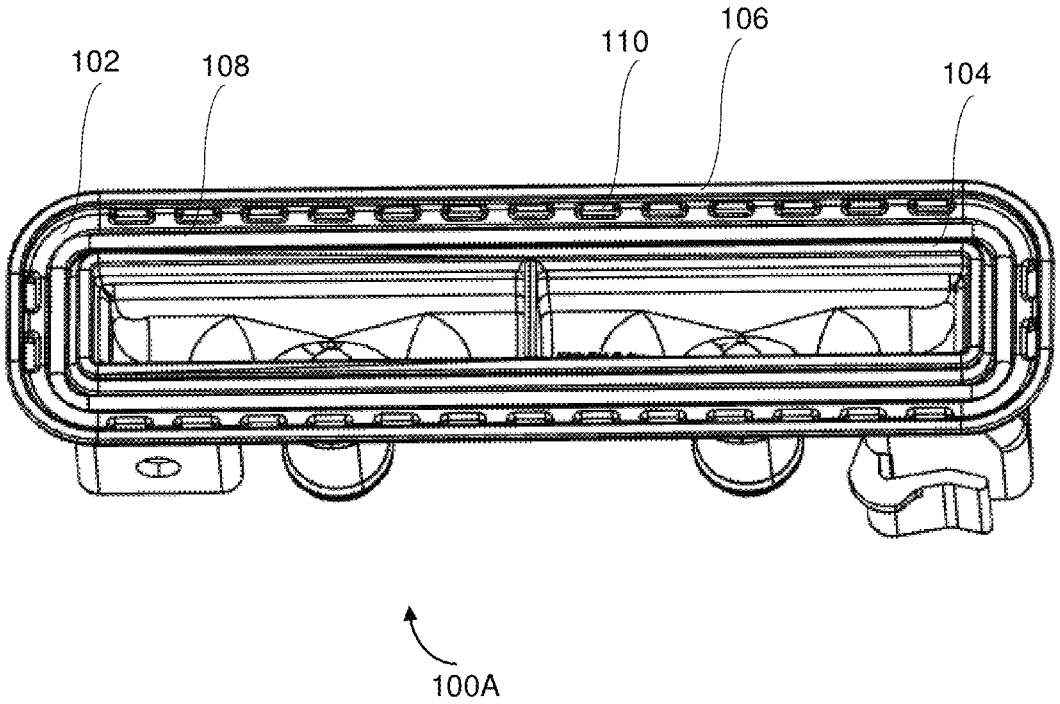
FIG. 2A illustrates a perspective view a tank showing a sealing member 108 of FIG. 1.
Figure 2B:
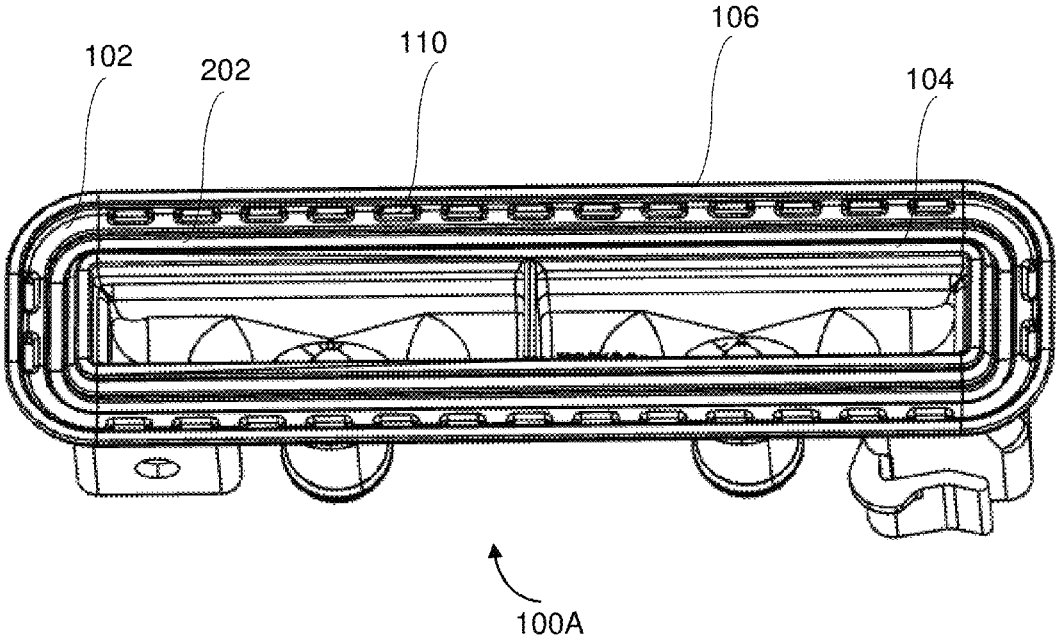
FIG. 2B illustrates a perspective view a tank showing a groove, in which the sealing member of FIG. 2A is received therein.

FIGS. 2A and 2B illustrate perspective views of the tank 100A of FIG. 1, in accordance with an embodiment of the present invention. The tank 100A includes a foot portion 102, an internal wall 104 and an outer wall 106. The foot portion 102 is formed in between the internal wall 104 and the outer wall 106. In other words, the internal wall 104 is formed at a first end of the foot portion 102, and the outer wall 104 is formed at a second end of the foot portion 102. The internal wall 104 and the outer wall 106 are perpendicularly protruded from the foot portion 102 and are parallel to each other. In one embodiment, the internal wall 104 and the outer wall 106 are formed throughout along the foot portion 102. Further, the foot portion 102 includes a groove 202 to receive a sealing member 108. In this example, FIG. 2A is a perspective view the tank 100A showing the sealing member 108, and FIG. 2B is perspective view of tank 100A showing the groove 202, in which the sealing member 108 is received therein. In one embodiment, the sealing member 108 can be a gasket or any other flexible material capable to seal leakages. In one example, the sealing member is disposed on the foot portion along an outer circumference of the internal wall 104. In the embodiment shown in FIGS. 2A and 2B, the groove 202 is formed on the foot portion 102 at a distance from the internal wall 102. Further, geometry and placement of the groove 202 is described in the forthcoming figures. Further, the tank 100A includes first coupling members 110 provided on the periphery of the tank to enable coupling with the header 100B.

Figure 3:
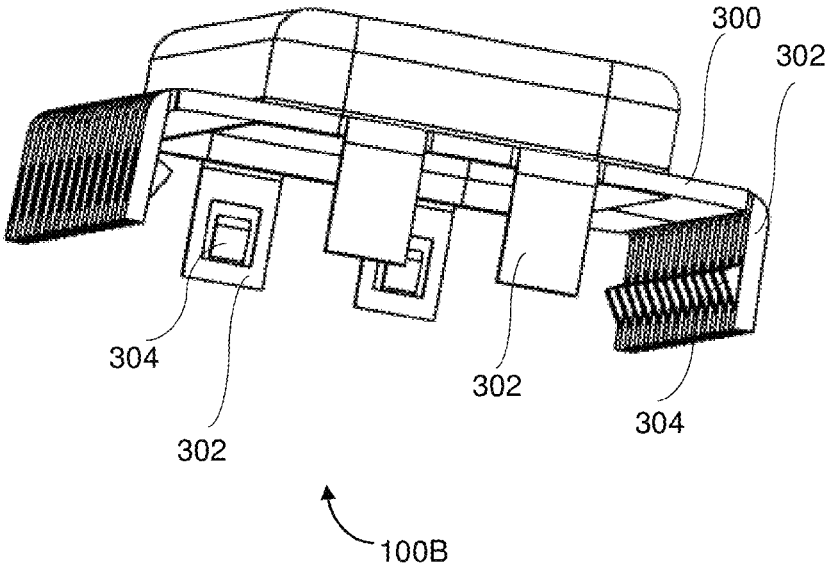
FIG. 3 illustrates a perspective view of the header of FIG. 1.

FIG. 3 illustrates a perspective view of the header 100B of FIG. 1. The header 100B includes second coupling members 302 formed on the periphery of the header 100B. In one embodiment, the second coupling members 302 are complementary to the first coupling members 110 formed on the tank 100A. Further, the header 100B may include a base portion 300, on which the second coupling members 302 are formed thereon. The second coupling members 302 are formed on the periphery of the base portion 300 of the header 100B. The second coupling members 302 are perpendicularly protruded from the base portion 300 of the header 100B, and are adapted to be coupled with the first coupling members 110 of the tank 100A, to enable connection between the tank 100A and the header 100B of the heat exchanger. In one embodiment, the second coupling members 302 are formed on the base portion 300 of the header 100B at regular intervals. In another embodiment, the second coupling members 302 are a single element formed throughout the base portion 300 of the header 100B. The second coupling members 302 further includes slopes 304 formed on inner side of the second coupling members 302 to couple with the first coupling members 110 of the tank 100A. In one embodiment, each second coupling member 302 has at least one slope 304. In another embodiment, one end of the second coupling members 302 is connected to the base portion 300 and other end of the second coupling members 302 can be crimped on the foot portion 102 of the tank 100A, upon the second coupling members 302 are coupled with the first coupling members 110.

Figure 4A:
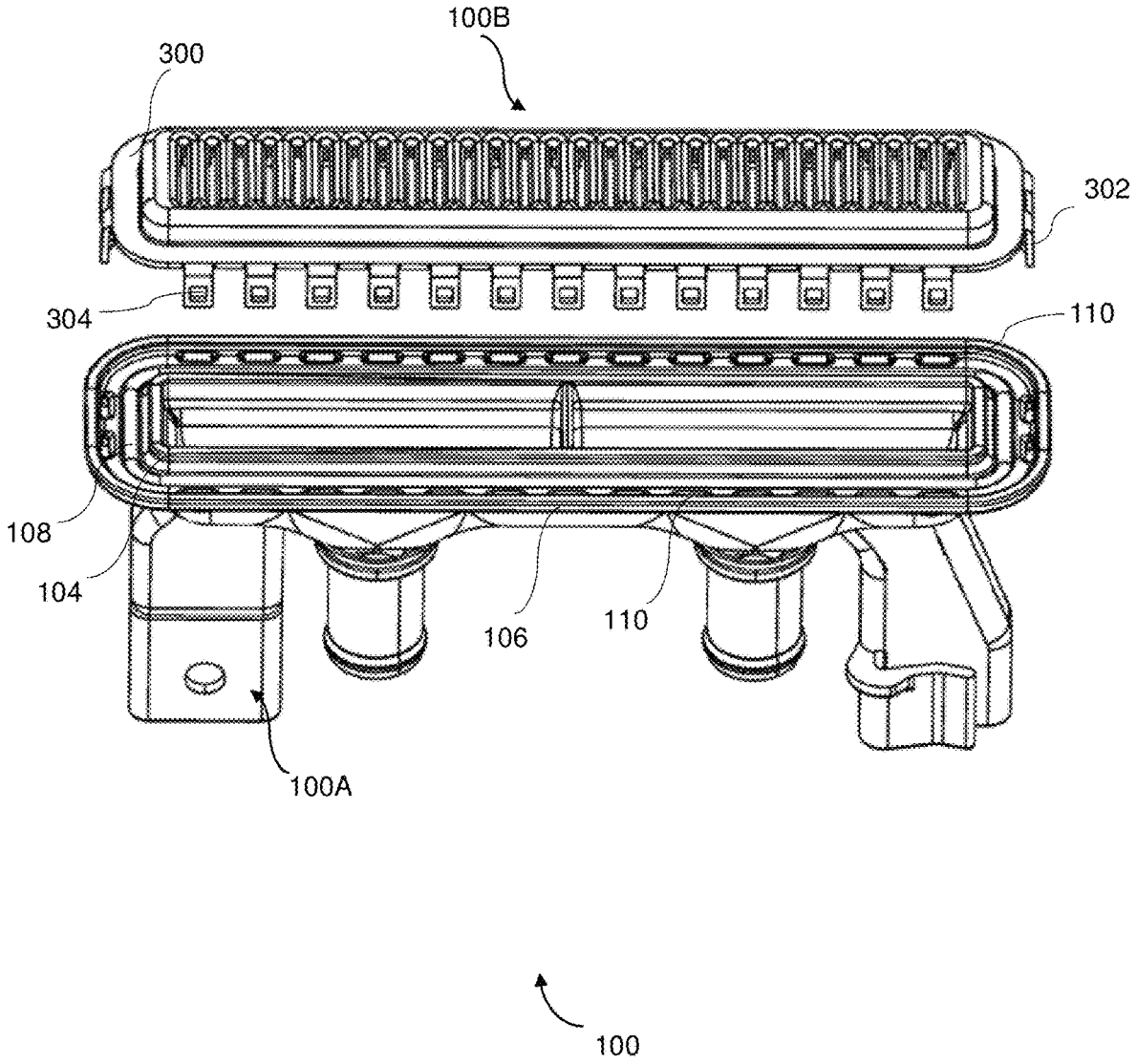
FIG. 4A illustrates an exploded view of the header-tank assembly of FIG. 1, in accordance with an embodiment of the present invention.
Figure 4B:
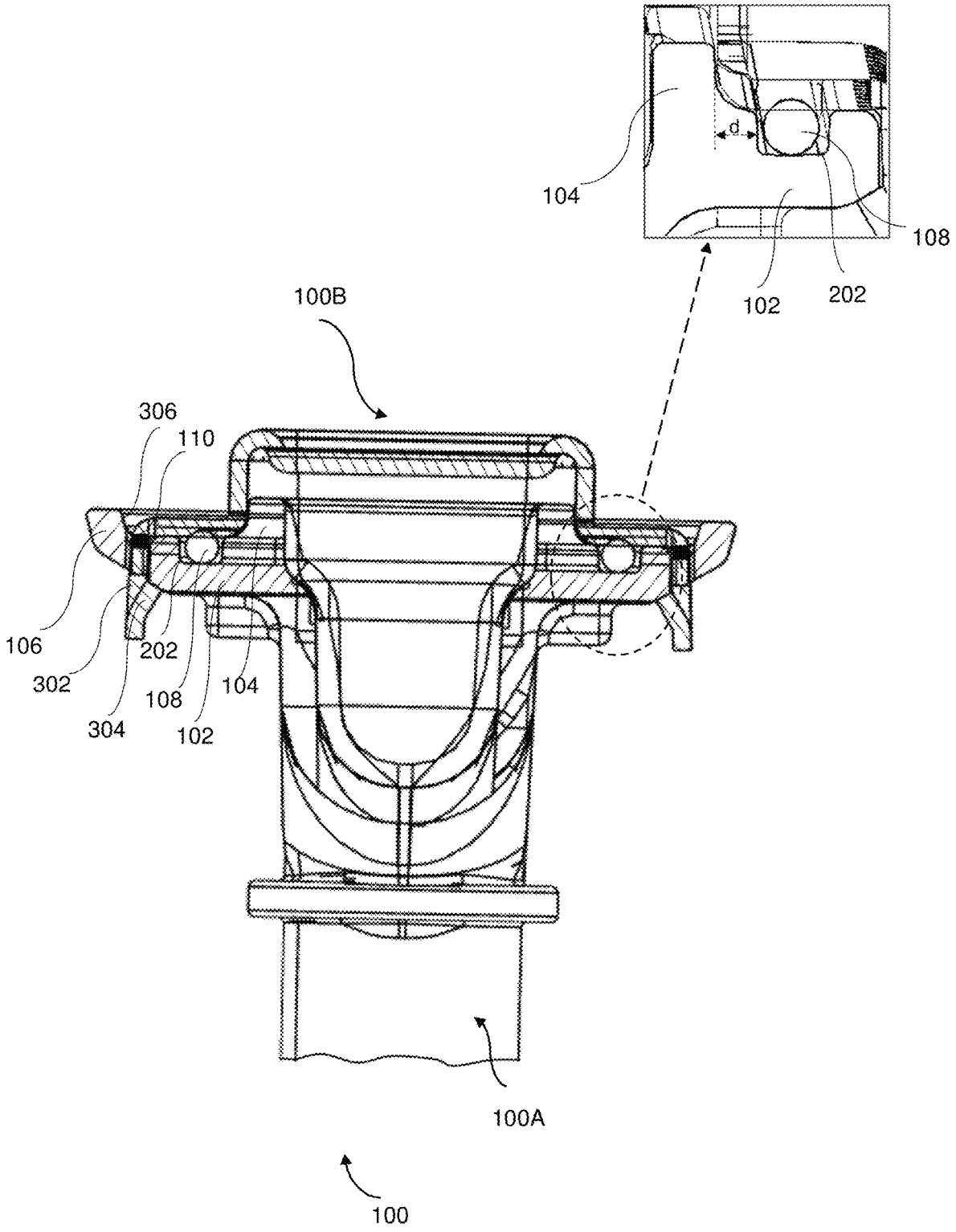
FIG. 4B illustrates a cross-sectional view of the header-tank assembly of FIG. 4A.
Figure 4C:
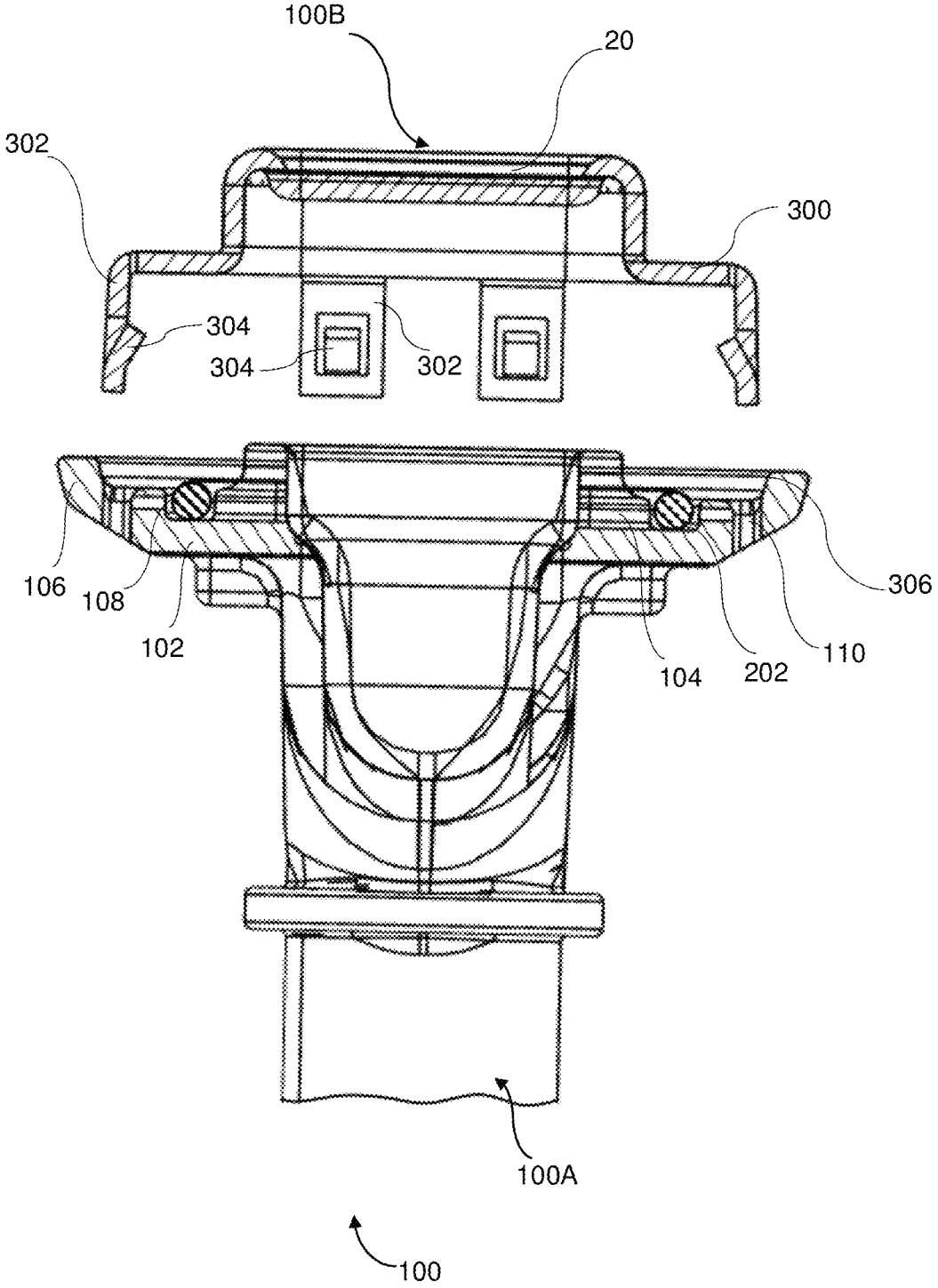
FIG. 4C illustrates an exploded cross-sectional view of the header-tank assembly, in which the header and the tank are separate from each other.

FIGS. 4A, 4B, and 4C illustrate different views of the header-tank assembly 100 of FIG. 1, in accordance with an embodiment of the present invention. FIG. 4A illustrates an exploded view of the header-tank assembly 100 of FIG. 1. In one embodiment, the first coupling members 110 are slots defined on the tank 100A and the second coupling members 302 are legs formed on the header 100B. Further, the legs 302 are adapted to be received in the slots 110 to couple the tank 100A on the header 100B. In the present embodiment, the first coupling member 110 and the second coupling member 302 are complementary to each other, so that the second coupling member 302 is engaged with the first coupling member 110 when the tank 100A is positioned and pressed against the header 100B. In the present embodiment, the groove 202 is formed on the foot portion 102 at a distance "d" from the internal wall 104 to avoid any pinching issues on the sealing member 108, when the tank 100A is coupled with the header 100B.

FIG. 4B illustrates a cross-sectional view of the header-tank assembly 100 of FIG. 4A, and FIG. 4C illustrates an exploded cross-sectional view of the header-tank assembly 100, in which the header 100B and the tank 100A are separate from each other. As shown in the FIG. 4A, the groove 202 is defined on the foot portion 102 of the tank 100A at the distance "d" from the internal wall 104. The groove 202 is so formed on the foot portion 102 that the groove 202 is complementary to the sealing member 108. In other words, the sealing member 108 is installed in the groove 202 in such a way that the sealing member 108 fits into the groove 202 without any bulging-out of the sealing member 108. Further, the sealing member 108 is stretched tight on the groove 202, so that the displacement of the sealing member 108 is avoided during assembling of the tank 100A on the header 100B. Therefore, damaging of the sealing member 108 is avoided and the sealing between the tank 100A and the header 100B is optimal.

Further, the second coupling members 302 being a protruded part are adapted to pass through the first coupling members 110 of the tank 100A as shown in FIG. 4B. As explained above, at least one slope 304 is formed on each of the second coupling member 302 to couple with the outer side of the foot portion 102, upon the at least one slope 304 passes through the first coupling members 110 as shown in FIG. 4B. The at least one slope 304 may slightly deform on passing through the first coupling members 110. In one embodiment, the at least one slope 304 possess the capacity to slightly deform and restore to original position when the tank 100A is assembled on the header 100B. As the second coupling members 302 are complementary to the first coupling members 110, the at least one slope 304 needs to be slightly deformed to pass through the first coupling members 110. Once the at least one slope 304 is passed through the first coupling members 110, the at least one slope 304 is restored to the original position and locked with the outer side of the foot portion 102. In other words, the at least one slope 304 is adapted to move outwards while the at least one slope 304 passes through the first coupling members 110, and adapted to move back to the original position once the at least one slope 304 is passed through the first coupling members 110. Further, the outer wall 106 of the tank 100A may include a ramp 306 to enable easy sliding of the second coupling members 302 into the first coupling members 110. The first coupling members 110 and the second coupling members 302 are collectively referred to as a connection assembly. In one embodiment, the connection assembly can be snap-fit assembly, poke-yoke configuration or any other connecting means.

In one embodiment, the groove 202 defined in the foot portion 102 of the tank 100A can be a U-shaped groove having an open end. Further, the open end of the U-shaped groove 202 can be closed when the tank 100A is positioned on the header 100B. In this example, the base portion 300 of the header 100B is adapted to close the open end of the groove 202, when the tank 100A is pressed against the header 100B. In one embodiment, the sealing member 108 may slightly protrude out from the open end of the groove 202. In other words, a cross-section of the sealing member 108 is slightly larger than that of the groove 202, thereby protruding out from the open end of the groove 202. Further, the base portion 300 of the header 100B is adapted to be in contact with the sealing member 108 and press against the groove 202, when the tank 100A is pressed against the header 100B. Simultaneously, the second coupling members 302 pass through the first coupling members 110, thereby forming a connection between the tank 100A and the header 100B. Further, outer side of the internal wall 104 of the tank 100A is in-contact/fluidically sealed with a vertical section of the base portion 300 of the header 100B, thereby enabling fluid communication between the tank 100A and the tube slots 20 of the header 100B.

Figure 5A:
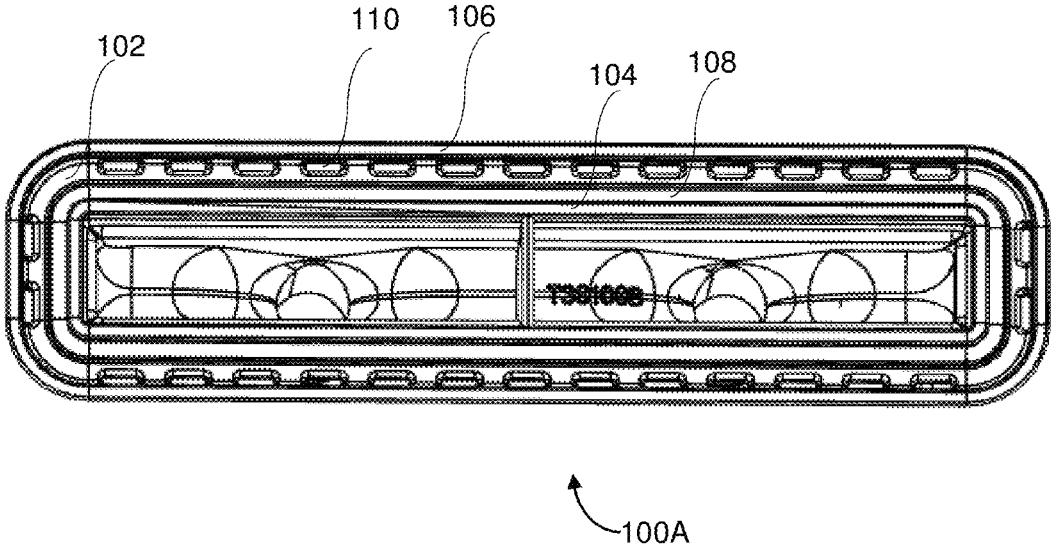
FIG. 5A illustrates a top view of the tank showing the sealing member, in accordance with another embodiment of the present invention.
Figure 5B:
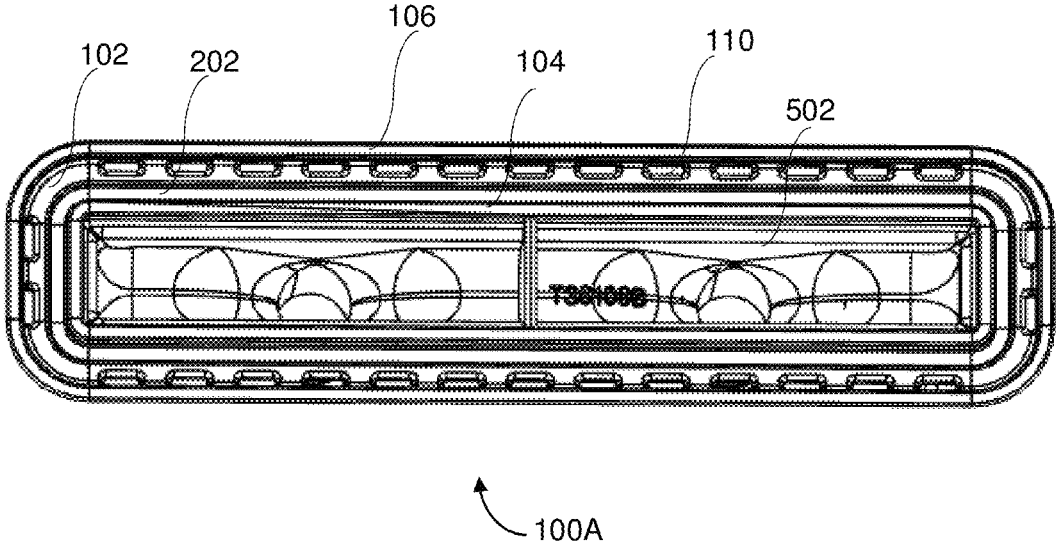
FIG. 5B illustrates a top view of the tank of FIG. 5A showing the groove, in which the sealing member is received therein.

FIGS. 5A and 5B illustrate tops views of the tank 100A of FIG. 1, in accordance with another embodiment of the present invention. In the present examples, FIG. 5A is a top view of the tank 100A showing the sealing member 108 and FIG. 5B is a top view of the tank 100A showing the groove 202, in which the sealing member 108 is received therein. According to the present embodiment, the groove 202 is formed at a corner connecting the internal wall 104 to the foot portion 102 of the tank 100A. The sealing member 108 is received in the groove 202 formed on the foot portion 102. As described above, the internal wall 104 formed on the foot portion 102 to define an opening 502, which is fluidically connected to the tube slots 20 formed in the header 100B, when the header 100B is connected to the tank 100A. Further, placement and geometry of the groove 202 is explained in the forthcoming figures.

Figure 6A:
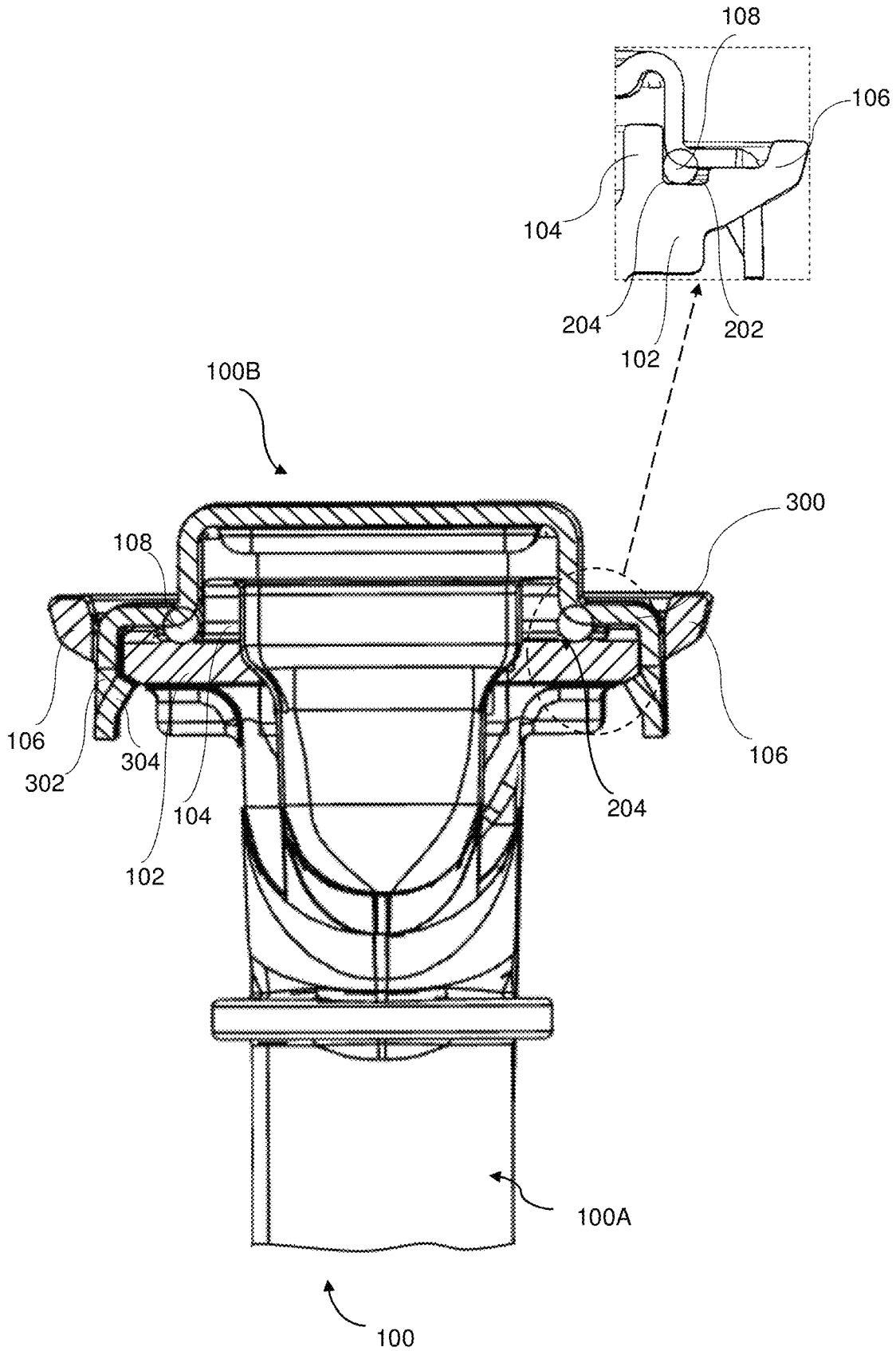
FIGS. 6A and 6B illustrate cross-sectional views of the header-tank assembly of FIG. 1, in accordance with another embodiment of the present invention.
Figure 6B:
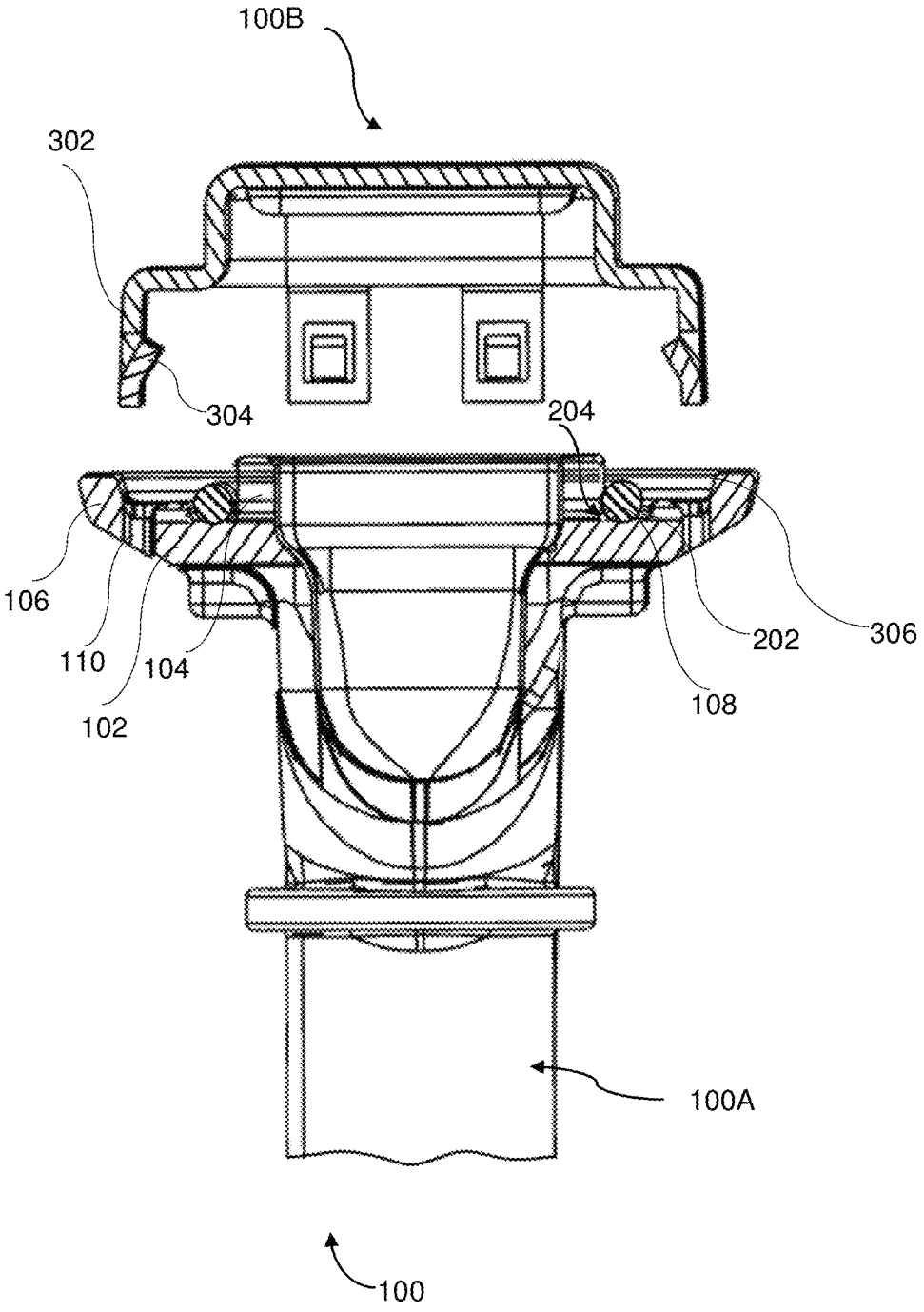

FIGS. 6A and 6B illustrate cross-sectional views of the header-tank assembly 100 having the tank 100A of FIG. 5A, in accordance with another embodiment of the present invention. According to the present embodiment, the groove 202 is formed on the foot portion 102, adjacent to the corner 204 connecting the internal wall 104 to the foot portion 102 as shown in the FIG. 6A. In other words, the groove 202 is formed on the foot portion 102 in such a way that the groove 202 is juxtaposed to the internal wall 104. Further, the base portion 300 has a corner that is adapted to be in contact with the sealing member 108 received in the groove 202 when the tank 100A is coupled with the header 100B. Further, the outer wall 106 of the tank 100A may include a ramp 306 to enable easy sliding of the second coupling members 302 into the first coupling members 110. In one embodiment, the first coupling members 110 being slots are defined on the foot portion 102 of the tank 100A and the second coupling members 302 being legs/tongues protruded out from the base portion 300 of the header 100B. In another embodiment, the first coupling members 110 can be legs/slots protruded out from the foot portion 102 of the tank 100A, and the second coupling members 302 can be slots defined in the base portion 300 of the header 100B. The first coupling members 110 and the second coupling members 302 are complementary to each other.

Once the sealing member 108 is disposed in the groove 202 defined on the foot portion 102, the tank 100A is pressed against the header 100B of the heat exchanger. Further, the base portion 300 of the header 100B is in contact with the sealing member 108 provided in the tank 100A, when the tank 100A is pressed against the header 100B. As the sealing member 108 is tightly fitted on the groove 202 defined in the tank 100A, displacement of the sealing member 108 is avoided, thereby the sealing member 108 provide optimal sealing between the tank 100A and the header 100B. Simultaneously, the second coupling member 302 is slid into the first coupling member 110, thereby reducing assembling time of the tank 100A on the header 100B.

Figure 7:
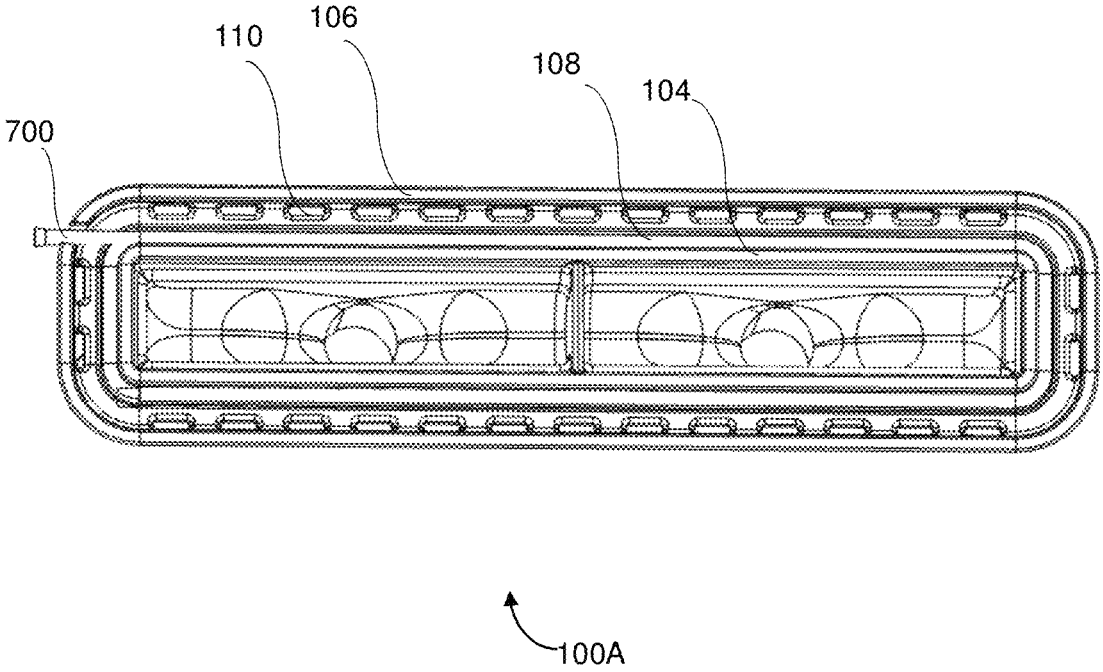
FIG. 7 illustrates a top view of the tank of the heat exchanger of FIG. 1, in accordance with another embodiment of the present invention.

FIG. 7 illustrates a top of the tank 100A of FIG. 1, in accordance with another embodiment of the present invention. According to this embodiment, the sealing member 108 may include protruded elements 700 connected at a side of the sealing member 108 and protruded out from one side of the tank 100A to enable easy inspection of the sealing member 108. The protruded elements 700 helps to visually inspect whether the sealing member 108 is received in the groove 202 or not.

In any case, the invention cannot and should not be limited to the embodiments specifically described in this document, as other embodiments might exist. The invention shall spread to any equivalent means and any technically operating combination of means.

What is claimed is:

1. A tank for a heat exchanger, comprising:

a foot portion;

an internal wall formed along the foot portion at a first end of the foot portion;

a sealing member disposed on the foot portion to provide a fluid-tight sealing between the tank and a header of the heat exchanger, when the tank is placed on the header; and at least one slot provided on the foot portion, adjacent to the sealing member, to couple with the header of the heat exchanger;

wherein the at least one slot is disposed between the internal wall and an outer wall running through the foot portion of the tank, wherein, in a direction perpendicular to the internal wall, the at least one slot is separated from the sealing member by a protrusion, the protrusion extending in a direction parallel to the internal wall, and wherein the outer wall is formed along the foot portion at a second end of the foot portion such that the internal wall is parallel to the outer wall.

2. The tank as claimed in claim 1, wherein the internal wall and the outer wall perpendicularly protrude from the foot portion of the tank.

3. The tank as claimed in claim 1, further comprising a groove defined on the foot portion configured to receive the sealing member.

4. The tank as claimed in claim 3, wherein the groove is formed on the foot portion at a distance from the internal wall of the tank.

5. The tank as claimed in claim 3, wherein the groove is a U-shaped groove, wherein an open end of the U-shaped groove is adapted to be closed when the tank is positioned on the header.

6. The tank as claimed in claim 3, wherein the groove is defined on the foot portion at a corner connecting the internal wall with the foot portion of the tank.

7. A header-tank assembly comprising:

a tank comprising:

a foot portion, an internal wall formed along the foot portion at a first end of the foot portion, a sealing member disposed on the foot portion to provide a fluid-tight sealing between the tank and a header of a heat exchanger, when the tank is placed on the header, and at least one slot provided on the foot portion, adjacent to the sealing member, to couple with the header of the heat exchanger, wherein the at least one slot is disposed between the internal wall and an outer wall, on the foot portion of the tank, wherein, in a direction perpendicular to the internal wall, the at least one slot is separated from the sealing member by a protrusion, the protrusion extending in a direction parallel to the internal wall, and wherein the outer wall is formed along the foot portion at a second end of the foot portion such that the internal wall is parallel to the outer wall;

the header of the heat exchanger; and at least one leg, complementary to the at least one slot, formed on a periphery of the header, wherein the at least one leg is adapted to be coupled with the at least one slot formed on the tank to enable a connection between the header and the tank, wherein the at least one leg is adapted to be received through the at least one slot and configured to couple the tank on the header.

8. The header-tank assembly as claimed in claim 7, wherein the leg includes a slope configured to be deformed when the leg passes through the at least one slot formed in the tank, to lock the tank with the header.

9. The header-tank assembly as claimed in claim 7, wherein the leg is configured to be crimped over the foot portion of the tank, upon the leg passing through the at least one slot formed on the foot portion of the tank.

10. The header-tank assembly as claimed in claim 7, wherein the at least one slot and the at least one leg are a snap fit assembly adapted to couple with each other.

11. The header-tank assembly as claimed in claim 7, wherein the foot portion of the tank further comprises a ramp formed on the outer wall formed along the foot portion to enable sliding of the at least one leg into the at least one slot.

12. The header-tank assembly as claimed in claim 7, wherein the sealing member further comprises protruded elements connected to the sealing member at a side of the sealing member.

* * * * *